United States Patent [19]

Dahlitz

[11] Patent Number: 4,702,028

[45] Date of Patent: Oct. 27, 1987

[54] PATCH FOR MUZZLE LOADING RIFLES

[76] Inventor: Ronald R. Dahlitz, 2232 Angelcrest Dr., Hacienda Heights, Calif. 91745

[21] Appl. No.: 1,211

[22] Filed: Jan. 7, 1987

[51] Int. Cl.[4] ..... F41C 27/00

[52] U.S. Cl. ..... 42/90; 42/95; 102/532

[58] Field of Search ..... 42/90, 95; 102/532

[56] References Cited

U.S. PATENT DOCUMENTS

| | | | |
|---|---|---|---|
| 3,205,518 | 9/1965 | Romaine | 42/90 |
| 4,050,175 | 9/1977 | Mulinix | 42/90 |
| 4,152,858 | 5/1979 | Dobbs | 42/90 |
| 4,207,698 | 6/1980 | Burson | 42/90 |
| 4,536,983 | 8/1985 | Fry | 42/90 |
| 4,601,125 | 7/1986 | Curtis | 42/90 |

*Primary Examiner*—Charles T. Jordan

*Attorney, Agent, or Firm*—Edgar W. Averill, Jr.

[57] ABSTRACT

An improved patch for use with muzzle-loading guns. The patch is made from a circular swatch of fabric which has at least three identical, symmetrical indentations formed in the periphery of the patch. The indentations reduce the tendency of the patch to interfere with the ball as it is being shot from the firearm.

8 Claims, 7 Drawing Figures

001211
FIG. 1. PRIOR ART
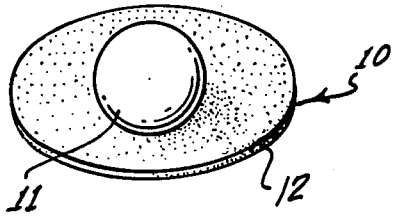
FIG. 5.
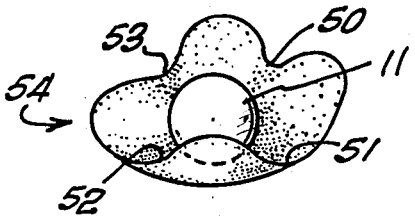
FIG. 2.
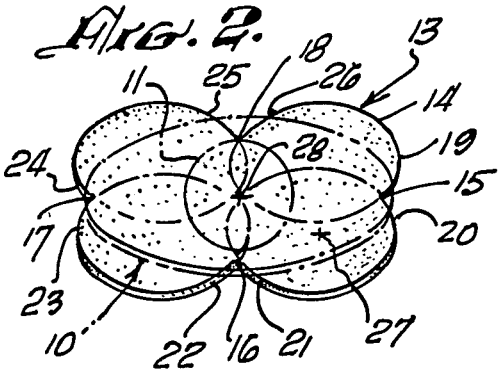
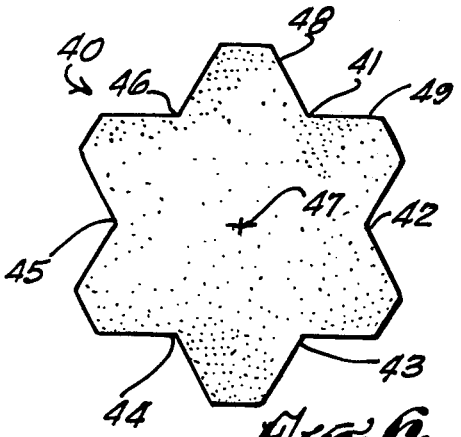
FIG. 6.
FIG. 3.
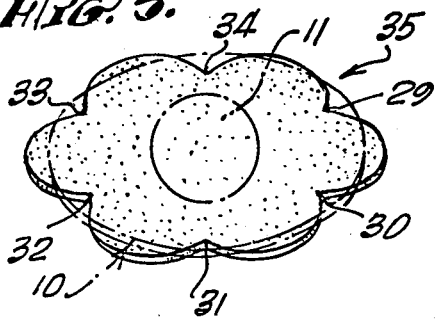
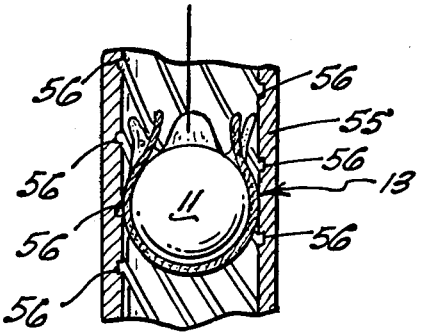
FIG. 7.
FIG. 4.
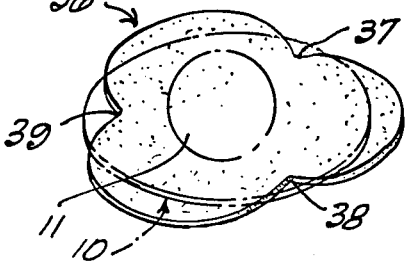

PATCH FOR MUZZLE LOADING RIFLES

BACKGROUND OF THE INVENTION

The field of the invention is firearms and the invention relates more particularly to muzzle-loading guns and to the patches used in conjunction therewith.

In the use of muzzle-loading guns, it has been common practice for many years to place a patch over the muzzle of the gun and then to place the ball on top of the patch and then to ram the ball down the rifle and against the grains of powder which have already been placed therein. Patches have invariably been made from a circular swatch of cloth and they function not only to hold the ball in the barrel, but also are often lubricated which, thus, lubricates the barrel as the shot is rammed down the barrel. The patches are substantially larger in diameter than the diameter of the ball and thus as they are folded upwardly around the ball, they tend to bunch in an uneven manner around the ball. As the gun is fired, the patch can cause an uneven force around the exterior of the ball which can constitute a source of inaccuracy for the shot.

SUMMARY OF THE INVENTION

It is, thus, an object of the present invention to provide a patch which holds more evenly around a rifle ball.

The present invention is for an improved patch for use with muzzle-loading guns of the type fabricated from a circular swatch of fabric. The improvement comprises at least three identical, symmetrical indentations formed in the periphery of the patch, each of the symmetrical indentations being equally spaced from the center of the patch. Preferably, the indentations have curved arcuate sides, and a preferred patch has four indentations and has the arcuate edge of one side having the same center of curvature as the adjacent edge so that the final patch has four identical lobes.

BRIEF DESCRIPTION OF THE DRAWINGS

FIG. 1 is a perspective view of a prior art patch.

FIG. 2 is a perspective view of the patch of the present invention.

FIG. 3 is a perspective view of an alternate embodiment of the patch of FIG. 2.

FIG. 4 is a perspective view of an alternate embodiment of the patch of FIG. 2.

FIG. 5 is a perspective view of an alternate embodiment of the patch of the present invention together with a rifle ball.

FIG. 6 is a plan view of an alternate embodiment of the patch of FIG. 2.

FIG. 7 is a cross-sectional side view of the patch of FIG. 2 placed around a rifle ball and inserted into the barrel of a rifle.

DESCRIPTION OF THE PREFERRED EMBODIMENTS

A prior art patch is shown in FIG. 1 and indicated by reference character 10. A rifle ball 11 is shown in the top of patch 10 to indicate the relative size of the ball in the patch. Typically, a ball having a diameter of 0.490 inch would use a circular patch having a diameter of $1\frac{1}{8}$ to $1\frac{1}{4}$ inch and of a thickness of from 0.005 to 0.020 inch thick. The patch is typically fabricated from cotton, although linen and other fabric materials can also be used.

In use, the patch 10 is placed on the muzzle of a rifle and the rifle ball 11 is placed on top of the patch and naturally pushes the patch slightly downwardly into the muzzle. Typically, the ball is tapped down so that it is fully below the muzzle, after which a ramrod is used to shove the ball and patch down the barrel until it rests on the powder which has, obviously, been poured therein. Of course, when a circular object is wrapped around a ball, the outer periphery 12 naturally must be folded and bunched to account for the excess material resulting from its being folded around the ball. This folding is inherently not completely symmetrical and as the ball is shot out of the gun, the patch tends to bunch up more at one edge of the ball than at another edge. This uneven force creates a source of inaccuracy and the patch of the present invention reduces this by providing a plurality of indentations around the outer periphery of the patch.

A patch made according to the present invention is shown in perspective view in FIG. 2 and indicated by reference character 13. Patch 13 has an outer periphery 14 which includes four indentations 15 through 18. These indentations tend to reduce the bunching of the patch around the ball as indicated in FIG. 7 where it can be seen that the excess material is reduced by the indentation such as indentation 15 shown in FIG. 7.

The particular construction of the patch of FIG. 2 is a preferred form. It can be seen that indentation 15 has two sides 19 and 20 which are curved and, more particularly, are part of two circles. Indentation 16 has sides 21 and 22; indentation 17 has sides 23 and 24; and indentation 18 has sides 25 and 26. In the preferred construction of the patch of FIG. 2, sides 20 and 21 are arcs which have the same center of curvature indicated by reference character 27. Thus, patch 13 has four semicircular lobes comprising portions of four imaginary circles, which circles are indicated by dotted lines, and the four circles all about touch at the center 28 of the patch.

It is not essential, however, that the patch have four indentations and a six indentation patch is shown in FIG. 3 where the indentations are indicated by reference characters 29 through 34. The patch is indicated by reference character 35 and the rifle ball by reference character 11.

A three-indentation patch 36 is shown in FIG. 4 and the indentations are indicated by reference characters 37, 38 and 39.

It is also possible that the improved patch have indentations with straight sides such as patch 40 shown in FIG. 6. Patch 40 has indentations 41 through 46 which are all equally spaced from the center 47 of patch 40. Each indentation has two angled sides such as sides 48 and 49 of indentation 41, and all of the indentations are identical and centered about center 47.

As shown in FIG. 5, the patch may also have curved indentations such as indentations 50 through 53 of patch 54.

The important element of the patch of the present invention is that it has at least three indentations and that the indentations be symmetrical about the center of the patch. In this way, the bunching of the patch around the rifle ball is substantially reduced and, yet, is symmetrical about the ball. A portion of a rifle barrel 55 is shown in FIG. 7 and includes rifling grooves 56 which, of course, cause the rifle ball 11 to spin as it leaves the muzzle. The patch 13 is substantially less bunched about rifle ball 11 than would be the prior art patch 10. It still sufficiently surrounds ball 11 to provide its three functions, namely, to create a gas seal for the ball between the ball and the inner surface of the rifle; secondly, to partially fill into the rifling to assist in placing a twist on the ball as it is being shot; and thirdly, to lubricate the barrel both as it is rammed into the barrel and as it is shot out of the barrel in those instances where the patch, itself, is lubricated.

Although the art of muzzle-loading rifles is an ancient art, the patch of the present invention provides a significant decrease in the uneven force on the rifle ball as it is being shot. At that same time, it continues to provide all the important functions of the patch.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved patch for use with muzzle-loading firearms of the type fabricated from a circular swatch of fabric, wherein the improvement comprises:

at least three identical, symmetrical indentations formed in the periphery of said patch, each of said symmetrical indentations being equally spaced from the center of said patch.

2. The improved patch of claim 1 wherein each of said indentations has a pair of convex, arcuate sides.

3. The improved patch of claim 2 wherein the center of curvature of one of the arcuate sides of one indentation is coincident with the center of curvature of the arcuate side of its adjacent indentation whereby the shape of two adjacent sides is the arc of a circle.

4. The improved patch of claim 1 wherein there are four indentations.

5. The improved patch of claim 3 wherein there are four indentations and thereby there are four arcs of four adjacent imaginary circles formed by the sides of the indentations.

6. The improved patch of claim 5 wherein the four imaginary circles formed by the arcuate sides of each of the four indentations meet at about the center of the patch.

7. The improved patch of claim 1 wherein the sides of said symmetrical indentations are straight.

8. An improved patch for use with muzzle-loading guns of the type fabricated from a circular swatch of fabric, wherein the improvement comprises:

at least three and no more than eight identical, symmetrical indentations formed in the periphery of said patch, each of said symmetrical indentations being equally spaced from the center of said patch and each of said symmetrical indentations having arcuate sides.

* * * * *